United States Patent [19]

Träubel et al.

[11] Patent Number: 5,009,921

[45] Date of Patent: Apr. 23, 1991

[54] PROCESS FOR FINISHING LEATHER

[75] Inventors: Harro Träubel; Heinrich Strenger, both of Leverkusen; Karl A. Weber, Betzweiler; Hans-Werner Müller, Cologne; Horst Zäpfel, Karlsruhe; Axel Hummel, Neuffen, all of Fed. Rep. of Germany

[73] Assignee: Bayer Aktiengesellschaft, Leverkusen, Fed. Rep. of Germany

[21] Appl. No.: 405,911

[22] Filed: Sep. 12, 1989

[30] Foreign Application Priority Data

Oct. 1, 1988 [DE] Fed. Rep. of Germany ..... 3833384

[51] Int. Cl.[5] ..... B05D 1/04; B05D 3/04; B05D 3/10

[52] U.S. Cl. ..... 427/31; 427/27; 427/335

[58] Field of Search ..... 427/377, 27, 31, 378, 427/335; 8/149.1, 150.5; 98/115.2

[56] References Cited

U.S. PATENT DOCUMENTS 4,484,812 5/1984 Lauke ..... 427/377

*Primary Examiner*—Evan Lawrence

*Attorney, Agent, or Firm*—Sprung Horn Kramer & Woods

[57] ABSTRACT

In the finishing of leather by spray application in an electrostatic field it is possible to use highly concentrated solutions if these solutions are sprayed into a solvent atmosphere in the presence of inert gases. The finishing process utilizes a solvent atmosphere which has a solvent content of 15-90% of the saturation concentration and a residual oxygen content of less than 10% by volume. The finishes contained are immediately stackable. By working with concentrated solutions it is possible to recycle the solvent from the waste air in an economically acceptable manner.

3 Claims, 1 Drawing Sheet

PROCESS FOR FINISHING LEATHER

Figure 1:
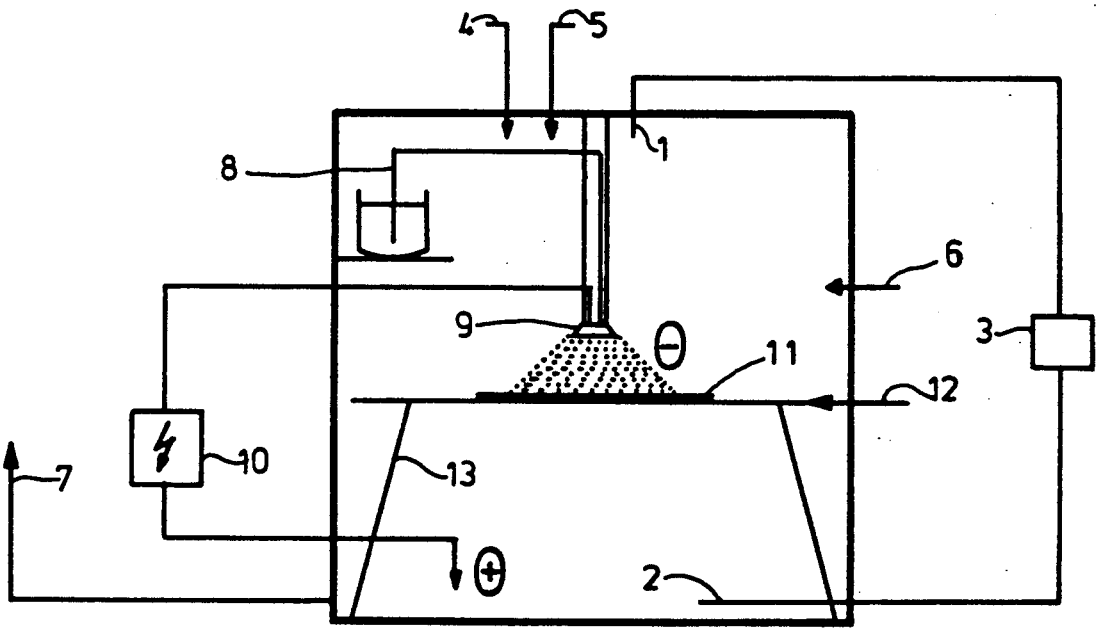

The present invention relates to a process for finishing leather by spray application of optionally water-containing organic solutions in an electrostatic field.

The hitherto most widely practiced process for finishing leather is spraying in an airstream or spraying airless, since these methods make it possible to obtain the best effects in respect of handle, outward appearance and rub and flex fastness properties.

On the other hand, this process also has a number of serious disadvantages. There are primarily the high spray losses of the material to be applied. Moreover, it requires the use of very dilute solutions (i.e. having solids contents of only about 2–4%), which makes it virtually impossible to recover the solvent from the waste air in an economically reasonable manner.

It has therefore already been proposed (cf. DE-A-3,611,729) to spray pieces of leather with finishing solutions in an electrostatic field.

This basically elegant process, however, has failed to become established in practice since, although it cuts down on spray losses, it does not reduce the absolute amount of organic solvents.

If, then, it is attempted to use concentrated solutions in an electrostatic field, it is generally observed that compared with the conventional spraying in an airstream or airless there is a deterioration in spray performance and spray distribution; that is, except for the more efficient application of the material being sprayed the process described in DE-A-3,611,729 does not offer any significant advantages.

It has now been found, surprisingly, that the disadvantages of the existing processes for finishing leather can be largely overcome if the finishing liquors are sprayed from the start into a water and/or solvent atmosphere which has a residual oxygen content of at most 15% by volume.

This novel process solves two important existing problems: it permits the use of highly concentrated spraying liquors and it permits the treating of the solvent-containing waste air in an economically acceptable manner.

The solids content of the finishing liquors can be up to 50% and the viscosity at the operating temperature can be up to 10,000 cP. Preference is given to using liquors which at the operating temperature have a viscosity of 500–5,000 cP. In general, the operating temperature is 20°–40° C. (i.e. approximately room temperature). However, in the case of very viscous polymer-containing liquors the temperature can also be raised to 60°–80° C. to reduce the viscosity.

The residual oxygen content of the solvent atmosphere is preferably less than 10, particularly preferred less than 7, % by volume.

The atmospheric oxygen content is reduced to these values by the introduction of inert gases, such as, for example, nitrogen, argon, $CO_2$ or in certain circumstances even water vapour.

The solvent content of the solvent atmosphere should be 10–100%, preferably 15–90%, particularly preferably 25–75%, of the saturation concentration. This is because if the solvent concentration is too close to saturation point, there may occur isolated instances of condensation and undesirable droplet formation. The solvents used for producing this atmosphere are preferably the same substances as are used for preparing the spray solution.

Suitable solvents are all the solvents used in the finishing of leather, such as, for example, esters, ketones, ethers, ether alcohols, alcohols, ether esters and aromatic hydrocarbons. Furthermore, the finishing liquors may contain customary leather auxiliaries, such as, for example, crosslinkers, waxes, dyestuffs, fillers, delustrants, pigments, handle control agents, viscosity regulators, dryness-standardizing agents and the like.

Basically, it is possible to use in the novel process all the polymers used in leather finishing, such as cellulose esters (nitrocellulose, cellulose acetobutyrate), polyamides, polyurethanes, polymers and copolymers of vinyl chloride, vinylidene chloride and vinyl acetate, etc.

It is also possible to process highly reactive 2-component systems of the type described for example in DE-A-3,309,992 by this technique. It is preferable to use here an electrostatic spray gun with an upstream mixing system as described for example in DE-A-2,746,188.

By the novel process it is possible to produce finishes for high-grade leathers of the type required in the furniture and automotive upholstery sector, it being particularly worth emphasizing that the pieces of leather, on appropriate drying, are immediately stackable following finishing.

The invention will be further described with reference to the accompanying drawing wherein:

FIG. 1 is a schematic of the apparatus used to carry out the process.

To carry out the novel process use is advantageously made of the spray booth depicted in FIG. 1, which is equipped essentially with two measuring positions, an oxygen meter, an inert gas and compressed air supply, a spray nozzle for the solvent, venting means, a spray bell, a finishing liquor, a high-voltage generator, transportation means for the workpiece and an earthed support table.

Before use the booth is rendered insert, for example with nitrogen, and sealed gas-tight. The oxygen of the air is displaced by the introduction of for example nitrogen (4) to less than 15, preferably less than 10, % by volume. Thereafter the interior of the spray booth is saturated with solvent. This solvent is sprayed into the spray booth through a spray gun (6) installed in the booth wall until 10–100% (preferably 15–90%) of the saturation concentration has been reached.

To measure the oxygen, the oxygen-containing gas is removed at measuring positions (1) and (2) and the oxygen content is determined by means of an oxygen meter (3). It is not until the safety value of 15% by volume or less of $O_2$ has been reached that the finishing process can be started by switching on the high voltage (10).

The finishing is carried out for example by the principle of the electrostatic high-speed rotation spraying process. By means of this electrostatic spraying technique a high-voltage field is generated between the spray bell (9) and the earthed workpiece (leather) (11). The liquid to be spray dispensed is pumped out of the finishing liquor (8) into the bell (9) rotating at a high speed and is finely atomized there. The atomized finish particles become negatively charged at the bell rim and are then guided by means of the electrostatic field forces to the earthed workpiece, where they deposit and release their charge. The earthed support table (13) transmits its earthing to the workpiece. It is of course also possible to apply the solutions using normal spray nozzles, i.e. an atomizing process which is carried out airless or with air.

After the finishing process has ended, the leather is transported out of the spraying zone by means of the transportation means (12). The solvent-charged atmosphere can be disposed of through the venting exit (7), for example by freezing out or absorbing the solvent, which can optionally be recirculated. If necessary, the interior of the spray booth can be ventilated with compressed air (5).

The detailed process conditions are described in the following examples:

EXAMPLE 1 a) A solution of product I (see below) was processed at 20° C. on an electrostatic spraying range of the Ransburg design. The electrostatic spraying range was installed in a booth which was filled with a gas mixture which by continuous inflow and outflow was changed a total of 15 times per hour and which consisted of a mixture of room air/oxygen in which the oxygen content was below 5% by volume.

The setting of the spray bell was adjusted to

| | |
|---|---|
| control air | 1.2 bar |
| ring air | 3.5 bar |
| revolutions of the bell | 10–35,000 rpm |
| voltage | 70 KV |

The solution was spray dispensed, but the only result was intensive thread formation in the air gap between bell and substrate of the type described colloquially as "spinning". Changes in respect of control air, ring air or speed of rotation had no effect.

b) Example 1*a* was repeated, except that the spray booth was charged with a gas mixture of nitrogen/diacetone alcohol (DAA), the booth atmosphere being saturated with DAA (10–11 g of DAA/m$^3$ of booth space). The result was a spray cone where no "spinning" was observable. On impingement of the product on the substrate—in this case a piece of cardboard to determine the amount of add-on—the solution spread out and formed a smooth film.

EXAMPLE 2 a) An experiment working with a 1:1 solution of product I in toluene/isopropanol 30% strength was carried out in the machine setting and in an atmosphere as in Example 1b at 25° C. The turbine of the bell barely revolved, since the viscosity of the solution was too high (viscosity at 20° C. was 200 cP).

b) Example 2*a* was repeated, except that the solution was heated to 80° C. and the speed of the turbine was set to 35,000 rpm. The result is a spray in which the solution was very well dispersed in droplet form, there was no sign of "spinning", and the spray cone had the ideal bell shape, and which leveled out on the leather to form a very good and uniform finish (the viscosity of the solution was 600 cP at the application temperature).

EXAMPLE 3

100 g of the solution of Example 2*b* were admixed with 20 g of a 20% strength solution of cellulose acetobutyrate in 60:40 acetone/diacetone alcohol. This solution was likewise readily spray-dispensable.

EXAMPLE 4 a) A 30% strength aqueous dispersion of product II was spray dispensed in the booth, which was filled with room air, in accordance with the following recipe:

| | |
|---|---|
| 3 | parts of the PU dispersion 30% strength (18% solids content) |
| 2 | parts of water |
| 0.4 | part of a carbon black colouring |

The liquor had a viscosity which is characterized by an efflux time of 13" in the 4 mm Ford cup. Although the dispersion had a viscosity suitable for spray dispensing, the result was a poor spray distribution. The droplets of spray impinging on the substrate were already so dry at the surface that adequate flow was impossible.

b) Batch and machine setting as in Example 4a, except that the atmosphere in the spray booth was changed by blowing in diethyl ketone/water vapour and nitrogen. The material was satisfactorily sprayable, and the levelling on the substrate was immaculate.

EXAMPLE 5

A PUR reactive system which at RT has a viscosity of about 3,000 cP and a solids content of 90% was spray dispensed.

Composition

| | |
|---|---|
| 50 | parts of the PES/polyurethane/NCO prepolymer mentioned under product III |
| 50 | parts of the PE/polyurethane/NCO prepolymer mentioned under product III |
| 15 | parts of a mill base in cyclohexane of an iron oxide pigment of brown colour |
| 5 | parts of a silicone oil |
| 10 | parts of methoxypropyl acetate and |
| 5 | parts of diethylene glycol |

The batch was not sprayable in this consistency (of 12,000 cP at 20° C.), but on warming to 80° C. the viscosity was reduced to 600 cP and the batch because sprayable with very good levelling properties.

The control air was adjusted to 3 bar; the turbine had a speed of 40,000 rpm.

EXAMPLE 6

As a modification of Example 1 of DE-A-2,637,115 the following experiment was carried out:

Two metering pumps, one for prepolymer A (see below) and the other for hardener 1, were used to convey into a mixing chamber incorporating a mixer as described in EP-A-1,581, where mixing took place with the aid of nitrogen and the mixture was sprayed with a spray gun provided with a spray electrode onto an oppositely charged (earthed) mould adhesively bonded to an aluminium plate. Owing to the solvent present in the spray booth atmosphere, the levelling of the sprayed material on the mould was excellent. The composition sprayed onto the mould leveled out in the manner of a film and began to set after about 1 minute, calculated from the time of spraying. The reacting composition had placed on top of it the split leather to be coated, which was pressed in place. The total coating then passed through a hot drying duct at 80° C. After about 6 minutes, calculated from the time of spraying, the coating was peeled without tackiness from the mould.

The polyurethane urea layer had a thickness of 0.22–0.25 mm.

The coated split leather had a grain confusingly similar to natural leather, and after a short time it was dry, stackable and processible on conventional shoe machines. The adhesion between coating and split leather was excellent, and the handle was pleasantly dry.

EXAMPLE 7

A prepolymer was prepared from equal parts by weight of a polydiethylene glycol adipate (molecular weight 2,000) and polyethylene glycol (molecular weight 400) by means of isophorone diisocyanate, and the prepolymer was advanced with hydrazine hydrate to a polyurethane urea. Polyurethane was present as a 40% strength solution in 3:3:1 toluene/isopropanol/2-methoxypropanol. The solution had a viscosity which was not measureable in a DIN cup (4 mm; DIN 53211); (in a Haake viscometer the viscosity was more than 20,000 cP at 22° C.). Nor was it sprayable.

The dilution with the same solvent mixture as in Example 8 to a viscosity of 85 seconds (180 cP at 22° C.) and a concentration of 14.5% produced a solution which was still not sprayable by the airless technique but which was already excellently processible according to the invention.

By the airless technique this product was conventionally processible only at a concentration of 11.4% and a viscosity of 17 seconds.

EXAMPLE 8

1 part of a polyurethane of hexane diisocyanate (3.5 parts) and (96.4 parts) of polyester of butanediolhexanediol polyadipate (molecular weight 5,000) and trimethylolpropane (0.04 part)

and 2 parts of a cellulose acetobutyrate were dissolved at 15% strength in a 1:1 mixture of ethyl acetate and butyl acetate. The solution had a viscosity of 70 seconds in a DIN cup (200 cP at 22° C.). By the method of the invention it was excellently sprayable, but by the airless technique it only became sprayable on dilution to below 8% (viscosity: 20 seconds).

In what follows, the products used above are described in more detail.

Product I

One-component thermoplastic polyester-polyurethane as 30% strength solution in 1:1 toluene/isopropanol consisting of an adipic acid/hexanediol polyester having an average molecular weight of 2,000 reacted with isophorone diisocyanate in a molar ratio NCO:OH of 1:1.

Product II

30% strength diethyl ketone/water (1:9) dispersion of a polyester urethane consisting of a polyester of adipic acid/dihydroxypropionic acid/hexanediol having a molecular weight of 1,600 with free COOH groups, which serve as hydrophilic free COOH components, saturation of the free COOH components by an aliphatic diamine and reaction of the resulting polyester with isophorone diisocyanate at a molar ratio NCO/OH of 1:1.

Product III

A highly reactive 2-component polyurethane as described in DE-A-2,637,115, consisting of a 70% strength polyester prepolymer of adipic acid/hexanediol of molecular weight 2,000 reacted with TDI-2,4 in a molar ratio NCO:OH of 2:1 and dissolved in toluene with an 80% solids content. It is used together with a polyetherpolyurethane consisting of 4,4'-diisocyanatodiphenylmethane and a polyether consisting of polypropylene glycol ether (molecular weight 2,000) (NCO:OH=2:1) in the mixing ratio of 1:1.

Prepolymer A

A reactor is charged with 444 g of 1-isocyanato-3-isocyanatomethyl-3,5,5-trimethylcyclohexane (isophorone diisocyanate). At room temperature, 9 g of 1,4-butanediol, 9 g of trimethylolpropane and 1,600 g of a hydroxy polyester of adipic acid, ethylene glycol, diethylene glycol and 1,4-butanediol having a hydroxyl number of 56 and a molecular weight of 2,000 were added in succession with stirring. The reaction mixture was heated and maintained at 110° C. for about 1 hour (until NCO is constant). After cooling down to 65° C., the reaction mixture was diluted with 412 g of methyl ethyl ketone and 206 g of toluene, corresponding to a 77% strength solution.

The prepolymer solution had a viscosity at 20° C. of 1,000 cP.

Hardener 1

A mixture of 170 g of 3,3,5-trimethyl-5-aminomethylcyclohexylamine (IPDA), 13 g of water and 417 g of methyl ethyl ketone was refluxed for 2 hours. After cooling down, the mixture was ready for use as a hardener.

Of the 170 g (1 mole) of IPDA used, there were present in the mixture:

A) 12.9 mol% as free IPDA

B) 41.6 mol% as

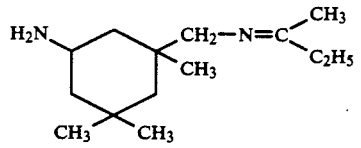

c) 45.5 mol% as the bis-methyl ethyl ketone ketimine of IPDA

The mixture also contained in total 37.88 g of water.

We claim:

1. A process for finishing leather comprising spraying onto leather in an electrostatic field a finishing liquor having a viscosity at the operating temperature of 500–5,000 cP, the finishing liquor being a spray dispersed from the start in a solvent atmosphere which contains an organic solvent and optionally water and which has a solvent content of 15–90% of the saturation concentration and which has a residual oxygen content of less than 10% by volume.

2. A process according to claim 1, wherein the residual oxygen content is less than 7, by volume.

3. A process according to claim 1, wherein said atmosphere contacts an inert gas.

* * * * *

UNITED STATES PATENT AND TRADEMARK OFFICE

CERTIFICATE OF CORRECTION

PATENT NO. : 5,009,921

DATED : April 23, 1991

INVENTOR(S) : Traubel et al.

It is certified that error appears in the above-identified patent and that said Letters Patent is hereby corrected as shown below:

| | |
|---|---|
| Title Page | U.S. PATENT DOCUMENTS: Delete " 4,484,812 " and substitute -- 4,448,812 -- |
| Col. 6, claim 3 line 2 | Delete " contacts " and substitute -- contains -- |

Signed and Sealed this

Twenty-seventh Day of April, 1993

*Attest:*

MICHAEL K. KIRK

*Attesting Officer*

*Acting Commissioner of Patents and Trademarks*